United States Patent [19]

Ohnishi

[11] Patent Number: 4,833,286

[45] Date of Patent: May 23, 1989

[54] MICROWAVE STIRRER FOR MICROWAVE OVEN

[75] Inventor: Akira Ohnishi, Yamatotakada, Japan

[73] Assignee: Sharp Kabushiki Kaisha, Osaka, Japan

[21] Appl. No.: 30,681

[22] Filed: Mar. 26, 1987

[30] Foreign Application Priority Data

Mar. 29, 1986 [JP] Japan ..... 61-47000[U]

[51] Int. Cl.[4] ..... H05B 6/72

[52] U.S. Cl. ..... 219/10.55 F

[58] Field of Search ..... 219/10.55 F, 10.55 E, 219/10.55 R

[56] References Cited

U.S. PATENT DOCUMENTS

| | | | |
|---|---|---|---|
| 3,867,605 | 2/1975 | Yee | 219/10.55 |
| 4,176,266 | 11/1979 | Kaneko et al. | 219/10.55 F |
| 4,286,135 | 8/1981 | Green et al. | 219/10.55 |
| 4,296,297 | 10/1981 | Miller | 219/10.55 F |
| 4,414,453 | 11/1983 | Simpson | 219/10.55 F |
| 4,436,973 | 3/1984 | Ikeda et al. | 219/10.55 F |
| 4,546,225 | 10/1985 | McCammon | 219/10.55 F |
| 4,556,772 | 12/1985 | McCammon et al. | 219/10.55 F |
| 4,568,811 | 2/1986 | Yoshimura et al. | 219/10.55 F |
| 4,641,006 | 2/1987 | Ross et al. | 219/10.55 F |

FOREIGN PATENT DOCUMENTS

| | | |
|---|---|---|
| 3301637 | 8/1983 | Fed. Rep. of Germany . |
| 2312165 | 12/1976 | France . |
| 1518970 | 7/1978 | United Kingdom . |
| 1543980 | 4/1979 | United Kingdom . |

*Primary Examiner*—Philip H. Leung

*Attorney, Agent, or Firm*—Birch, Stewart, Kolasch, & Birch

[57] ABSTRACT

A microwave oven comprises a microwave generator, a heating chamber, a waveguide for leading microwaves from the microwave generator to the heating chamber, a blower for generating air current in the waveguide, a microwave stirring member rotated by air current from the blower member for stirring microwave from the microwaves generator. The microwave stirring member comprises a rotating member being substantially vertical to the microwave propagation direction and having the rotation axis in the center, and microwave reflecting members with fins. The rotating member has a microwave receiving member substantially vertical to the microwave propagation direction, in the rotation center thereof, to receive microwave intensively, and a microwave feeding or radiating member extending from the rotation center and electrically communicating with the microwave receiving member, to feed or radiate microwaves in the heating chamber.

9 Claims, 2 Drawing Sheets

MICROWAVE STIRRER FOR MICROWAVE OVEN

BACKGROUND OF THE INVENTION

Description of the Background Art

The present invention relates to a microwave oven, and more particularly, to a microwave oven equipped with a microwave stirrer.

Conventionally, microwave ovens employ either of the following measures for ensuring uniform heating: a turntable to move the heated object, or a rotating antenna or a stirring fan to vary the electric field.

The microwave ovens with such measures have certain defects. For instance, the microwave oven in which the heated object is rotated has problems because it produces dead space in the heating chamber and that it requires a special motor to rotate the turntable. The microwave oven with a rotating antenna provides a high degree of freedom in varying the electric field because of the active movement of the microwave feeding section, but this oven has problems because it is not equpped for fine control of heating and because it involves a special motor for rotating the antenna. The microwave oven with a stirring fan, capable of fine control of heating, is a reflection-based passive type arrangement and therefore has a low degree of freedom in varying the electric field.

SUMMARY OF THE INVENTION

In view of the above problems of the conventional microwave oven, an object of the present invention is to provide a microwave stirrer of a microwave oven which ensures uniform heating without producing dead space in the heating chamber.

Another object of the present invention is to provide a microwave oven including a microwave stirrer capable of stirring microwaves efficiently to ensure uniform heating.

Other objects and further scope of applicability of the present invention will become apparent from the detailed description of given hereinafter. It should be understood, however, that the detailed description of and specific examples, while indicating preferred embodiments of the invention, are given by way of illustration only, since various changes and modifications within the spirit and the scope of the invention will become apparent to those skilled in the art from this detailed description.

To achieve the above objects, according to an embodiment of the present invention, a microwave oven comprises a microwave generator, a heating chamber, a waveguide for leading microwave from the microwave generator to the heating chamber, microwave stirring means actuated by air current in the waveguide, and blower means for generating air current for rotating the microwave stirring means. The microwave stirring means comprises rotating means which is substantially vertical to the microwave propagation direction, which has microwave reflecting blades with fins and which has the rotation axis in the center. The rotating means includes a microwave receiving member such as a projection provided virtually parallel to the microwave propagation direction so as to receive microwave intensively, and a microwave feeding or radiating member such as a pointed end protruding from the rotation center and communicating electrically with the microwave receiving member so as to emit microwaves into the heating chamber.

The present invention is characterized in that microwaves are stirred by the rotating means comprising the microwave receiving section such as the projection for collecting microwave led through the waveguide, the microwave feeding or radiating section such as the protrusion for radiating or diffusing the microwave collected by the microwave receiving section, and the reflecting section such as reflecting blades permitting fine control of heating, the feeding or radiating section being deviated from the rotation axis and therefore circulating actively without requiring the use of a special motor, thereby substantially maximizing the electric field variation.

In the rotating means, the projection which constitutes the microwave receiving section communicates electrically with the protrusion which constitutes the microwave feeding or radiating section. The distance of electrical conduction thus formed is set to match the electrically and physically intended space impedance.

Since it is essential that the rotating means comprising the microwave receiving section, the microwave feeding or radiating section and the reflection section is rotated smoothly by the force of air current in the waveguide, it is preferably made of light conducting material such as aluminum.

Microwaves led through the waveguide are intensively received by the projection provided in the center of the rotating means by air current, and radiated uniformly into the heating chamber from the pointed end protruding outwardly from the rotating means center and circulating around the rotation axis as the rotating means rotates. Microwaves reflected from the heating chamber walls are returned to the rotating means and reflected again by the microwave reflection blades of the rotating means back into the heating chamber, whereby the microwaves are stirred uniformly in the heating chamber.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

An embodiment of the present invention will be described in detail below. It should be understood that the present invention is not limited by the following embodiment.

Figure 1:
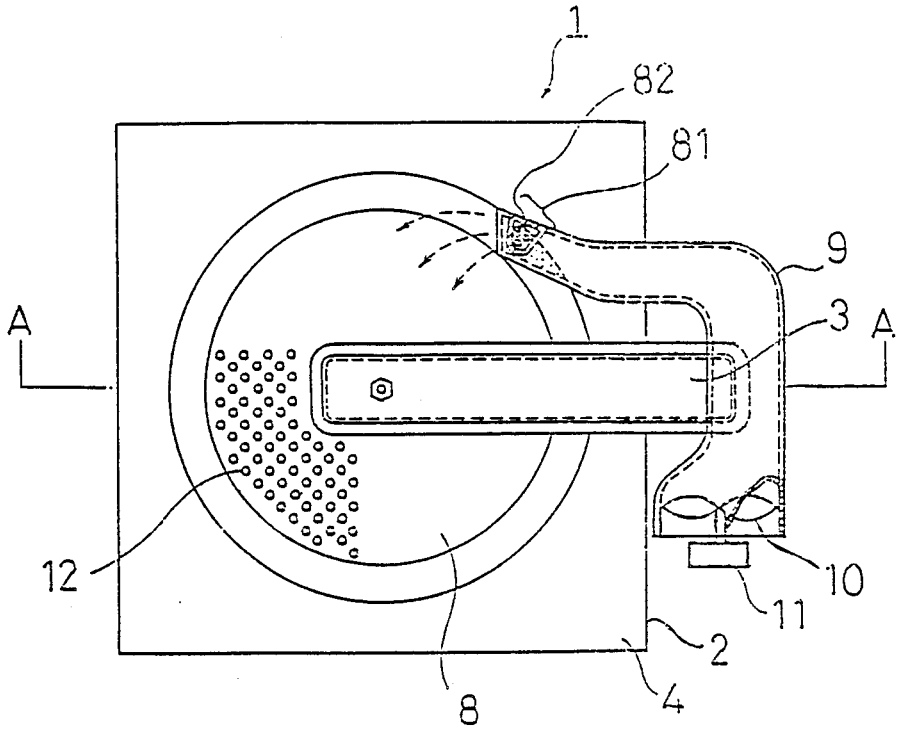
FIG. 1 is a plan view showing the arrangement of a blower member and a rotating member according to an embodiment of the present invention.
Figure 2:
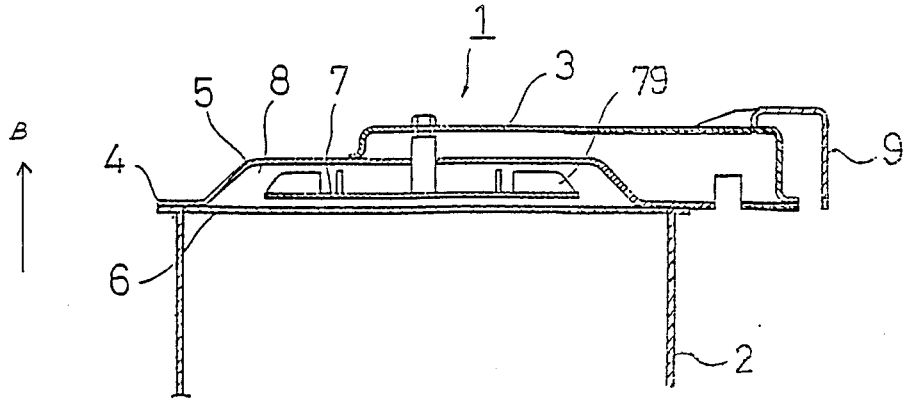
FIG. 2 is a sectional view along the line A—A of FIG. 1.
Figure 3E:
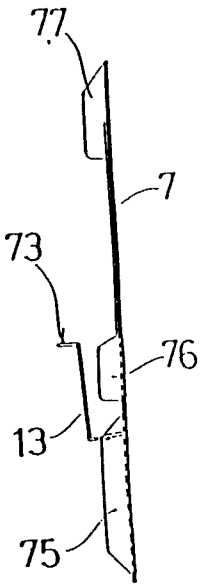
FIG. 3*e* shows a right side view of the rotating member of the present invention.
Figure 3C:
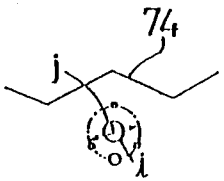
FIG. 3*c* shows an enlarged view of the center of the rotating member of the present invention.
Figure 3D:
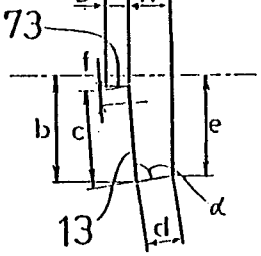
FIG. 3*d* shows a section taken along line A'—A' of FIG. 3*a;*.
Figure 3A:
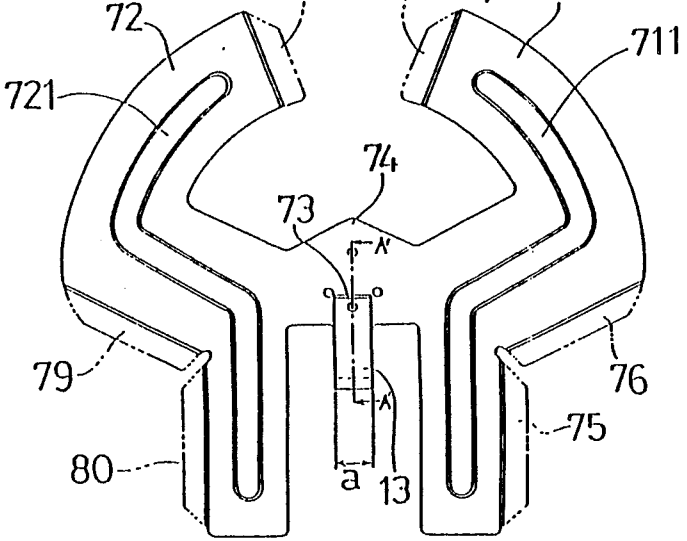
FIG. 3*a* shows a front view of the construction of an embodiment of the rotating member used in the microwave oven of the present invention.
Figure 3B:
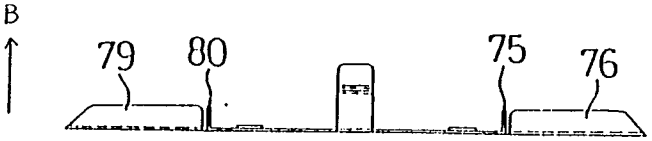
FIG. 3*b* shows a front end view of the rotating member of the present invention.

As set forth above, FIG. 1 is a plan view showing the arrangement of the blower member and the rotating member in the microwave oven of the present invention and FIG. 2 is a sectional view along the line A—A of FIG. 2.

Referring to FIGS. 1 and 2, a microwave oven 1 comprises a heating chamber 2 provided within an oven case (not shown), a microwave generator (not shown) composed of a high voltage transformer and a magnetron or the like, and a microwave-guide 3 connected to the microwave generator to lead microwaves to the heating chamber 2. The top plate 4 of the heating chamber 2 is drawn upwardly to form a recess 5. The lower opening of the recess 5 is closed by a cover plate 6 made of non-metallic material such as Mica to form a housing 8 in which a rotating member 7 is rotatably installed. The rotating member 7 may be a plate-like member.

A blower duct 9 has its open end at the area 81 in the housing 8 where suction apertures 82 are formed. On the other end of the blower duct 9, a blower fan 10 and a motor 11 for driving the blower fan 10 are installed. Exhaust apertures are designated by 12.

The construction of an embodiment of the rotating member 7 rotatably installed in the housing 8 of the microwave oven 1 of the present invention will be described now with reference to FIG. 3.

Reflection blades are designated by 71 and 72. A microwave receiving projection as a microwave receiving member is designated by 73. A microwave feeding or radiating protrusion as the microwave feeding or radiating member is designated by 74. Fins are designated by 75, 76, 77, 78, 79 and 80. The reflecting blades 71 and 72 are integrally provided with the fins 75, 76 and 77 and the fins 78, 79 and 80, respectively. A joint member 13 is provided for electrically connecting the microwave receiving projection 73 to the microwave feeding or radiating protrusion 74 which sticks out substantially vertically to the microwave propagation direction. The dimensions of the microwave receiving projection 73 and the joint member 13 are such that the distance between the microwave receiving projection 73 and the pointed end of the microwave feeding or radiating protrusion 74 matches the space impedance for intensively receiving microwave of a specified wavelength supplied from the waveguide 3 and for radiating the same in the heating chamber 2. In this embodiment of the present invention, the dimensions at a, b, c, d, e, f, g, h, i and j may be, for example, about 10 mm, about 29.5 mm, about 26 mm, about 10 mm, about 28 mm, about 4 mm, about 6.4 mm, about 12 mm, about 6.5 mm and about 15 mm, respectively.

In the embodiment of the present invention, the plate-like rotating member 7 is provided in a substantially "H"-like form and is symmetrically provided with respect to the line A'—A'. Each of the reflecting blades 71 and 72 have a substantially "V"-like portion and a circular-like curved portion connecting to the "V"-like portion. The microwave feeding or radiating member 74 is provided in a reversed "V" form. The joint member 13 is provided in a "L"-like form so that both ends of the joint member 13 are connected to the microwave feeding or radiating member 73 and the rotating member 7, respectively. The fins 75 to 80 are extended or bent in the arrow direction B as shown in FIGS. 2 and 3. Grooves 711 and and 721 are formed in the reflection blades 71 and 72, respectively, for reinforcement.

The microwave oven 1, according to the present invention, stirs microwaves by using the rotating member 7 in the following manner. When the motor 11 is actuated to rotate the blower fan 10, air current flows in the blower duct 9 and is supplied through the suction apertures 82 into the rotating member housing 8 under the top plate of the heating chamber 2, namely, into a chamber 8 stored the rotating member 7 therein. The air current collides with the fins 75 to 80 of the rotating member 7 in the housing 8, rotating the rotating member 7. When the fins 75 to 80 rotate, air is drawn through the suction apertures 82 and is discharged to the exterior through the exhaust apertures 12.

Meanwhile, microwaves from the microwave generator are led thorugh the waveguide 3 into the housing 8 and are received intensively by the projection as the microwave receiving member 73 provided in the center of the rotating member 7 which circulates around the rotation axis. The microwaves thus received flow in the form of microwave current from the projection 73 through the joint member 13 and the rotating member center, to the microwave feeding or radiating member 74 such as the protrusion which protrudes from the position near the rotating member center and which circulates around the rotation axis. Microwaves are then diffused and radiated outwardly from the microwave feeding or radiating protrusion 74. The diffused and radiated microwaves pass through the cover plate 6 into the heating chamber 2. A part of the microwave are reflected by the heating chamber inside walls, returned to the rotating member 7, and reflected again by the circulating reflection blades 71 and 72 of the rotating member 7 back into the heating chamber 2, thus stirring microwave in the heating chamber 2. In short, since microwave radiated from the circulating feeding or radiating member 74 is dispersed into the heating chamber 2 while it is stirred uniformly due to the reflection of microwave by the circulating reflection blades 71 and 72, the object is heated uniformly in the heating chamber 2.

As described above, the microwave oven of the present invention comprises the microwave generator, the heating chamber, the waveguide for leading the microwave from the microwave generator to the heating chamber, the microwave stirring member rotated by air current in the waveguide, and the blower member for rotating the microwave stirring member. The microwave stirring member comprises the rotating member which is set substantially vertical to the microwave propagation direction, which has the rotation axis in the center and which contains the microwave reflection blades with fins. The rotating member has the microwave receiving member such as the projection substantially parallel to the microwave propagation direction to intensively receive microwave and provided at the center of the rotating member, and the microwave feeding or radiating member such as a pointed end protruding outwardly from the rotation center so as to feed or radiate microwaves. The microwave receiving member such as the projection communicates electrically with the microwave feeding or radiating member such as the protrusion.

The most characteristic feature of the present invention is that the microwaves are stirred by the rotating member comprising the microwave receiving section for collecting microwaves led through the waveguide, the microwave feeding or radiating section for radiating or diffusing the microwave collected by the microwave receiving section, and the reflecting section which permits fine control of heating, the microwave feeding or radiating sectin being deviated from the rotation axis and circulating actively without requiring the use of a special motor so as to substantially maximize the electric field variation.

In the rotating member, the projection which constitutes the microwave receiving member communicates electrically with the protrusion having the pointed end which constitutes the microwave feeding or radiating member. The distance of electrical conduction achieved by this communication is set to match the electrically and physically intended space impedance.

The rotating member comprise the microwave receiving member, the microwave feeding or radiating member and the reflection member and it can be rotated smoothly by the force of air current in the waveguide. For this reason, the rotating member may be, preferably, made of light and electrical conducting material such as aluminum.

Microwaves led through the waveguide are intensively received by the projection as the microwave receiving member provided in the center of the rotating member by air current, and radiated uniformly into the heating chamber from the protrusion as the microwave feeding or radiating member which sticks out of the rotating member center and which circulates around the rotation axis as the rotating member rotates. Microwaves reflected from the heating chamber walls are returned to the rotating member and reflected again by the microwave reflection blades of the rotating member back into the heating chamber, whereby the microwaves are stirred uniformly in the heating chamber.

According to the present invention, as understood from the above, the microwave oven employs the rotating member which is rotated by air current and therefore does not require a special motor dedicated to rotate the rotating member.

Since the microwave receiving member and the microwave feeding or radiating member are provided with the rotating member, the microwave feeding or radiating member can move actively, resulting in a higher degree of freedom in varying the electric field.

Moreover, the rotating member has the reflecting blades, thereby enabling fine control of heating. The microwave oven of the present invention has little dead space, unlike a microwave oven with a turntable.

The microwave oven of the present invention can be manufactured at a lower cost than the one with a turntable or a rotating antenna and at substantially the same cost as the one with a stirring fan. This means that the present invention can realize a microwave of a low cost and, simultaneously, of higher uniform heating performance.

While only certain embodiments of the present invention have been described, it will be apparent to those skilled in the art that various changes and modifications may be made therein without departing from the spirit and scope of the present invention as claimed.

What is claimed is:

1. A microwave oven comprising:

a microwave generator;

a heating chamber;

a waveguide for leading microwaves from said microwave generator to said heating chamber along a microwave propagation path;

blower means for generating air current in said waveguide; and microwave stirrer means for stirring the microwaves in the heating chamber, said microwave stirrer means comprising:

rotation means for aiding stirring of said microwaves, said rotation means being rotatable about an axis located substantially at a central portion thereof, said rotation means being rotated by said air current from said blower means, said rotation means comprising at least two nonlinear blades for permitting fine control of heating, said blades each having raised portions running generally through the center thereof, said blades being generally located in the same plane except for said raised central portions thereof, each of said blades having a first portion and a second portion, said first portion of each blade being generally "C" shaped while said second portion of each blade is linear, each of said blades further having a first end and a second end, said first and second ends being on opposite sides of said axis, said blades being mirror images of one another, a receiving member provided substantially parallel to the microwave propagation path where said microwaves leave said waveguide, said receiving member being located along said axis in order to receive said microwaves, and a microwave feeding/radiating member in electrical communication with said receiving member, said microwave feeding/radiating member being noncoincident with said axis, said microwave feeding/radiating member diffusing and radiating said microwaves outwardly therefrom, said microwave feeding/radiating member being a generally V-shaped protrusion extending from said rotation means in a direction substantially perpendicular to said propagation path where said microwaves leave said waveguide, said microwave feeding/radiating member being rotatable with said rotation means in order to maximize electric field variation within said heating chamber, and said microwave feeding/radiating member being generally located in the same plane as said at least two nonlinear blades and being located between said at least two nonlinear blades.

2. The microwave oven of claim 1, wherein said rotating means is made of light and electrical conducting material.

3. The microwave oven of claim 2, wherein said rotating means is made of aluminum.

4. The microwave oven as recited in claim 1, wherein said microwave stirrer means further comprises a joint member, said joint member connecting said receiving member to said rotation means.

5. The microwave oven as recited in claim 4, wherein said at least two blades have raised fins thereon, said fins acting to catch said air current in order to rotate said rotation means, said microwave stirrer means being substantially flat along a noncentral, longitudinal cross section thereof except for said raised fins on said rotation means, said joint member and said receiving member.

6. The microwave oven as recited in claim 1, wherein said first end, said first portion and said second portion of each of said blades all further include a raised fin thereon, said fins acting to catch said air current in order to rotate said rotation means.

7. The microwave oven as recited in claim 1, wherein said rotation means includes raised fins thereon, said fins acting to catch said air current in order to rotate said rotation means.

8. The microwave oven as recited in claim 1, wherein said rotation means additionally reflects microwaves which return from said heating chamber to said rotation means, said microwaves which are so reflected being reflected back to said heating chamber.

9. The microwave oven as recited in claim 1, wherein said microwave feeding/radiating member uniformly radiates said microwaves into said heating chamber and wherein said rotation means additionally reflects microwaves which return from said heating chamber to said rotation means, said microwaves which are so reflected being reflected back to said heating chamber such that said microwaves are uniformly stirred in said heating chamber.

* * * * *